United States Patent [19]

Walker et al.

[11] 4,132,081

[45] Jan. 2, 1979

[54] MINE ROOF SUPPORT

[75] Inventors: John H. Walker; James A. Sutton, both of Cheltenham, England

[73] Assignee: Dowty Mining Equipment Limited, Tewkesbury, England

[21] Appl. No.: 775,995

[22] Filed: Mar. 9, 1977

[30] Foreign Application Priority Data

Mar. 13, 1976 [GB] United Kingdom ..... 10178/76

[51] Int. Cl.[2] ..... E21D 15/44

[52] U.S. Cl. ..... 405/296; 405/299

[58] Field of Search ..... 61/45 D; 299/31–33; 91/170 MP

[56] References Cited

U.S. PATENT DOCUMENTS

| | | | |
|---|---|---|---|
| 3,295,331 | 1/1967 | Blaser et al. | 61/45 D |
| 3,328,968 | 7/1967 | Weirich | 61/4 5 D |
| 3,855,805 | 12/1974 | Nakajima | 61/45 D |

FOREIGN PATENT DOCUMENTS

| | | | |
|---|---|---|---|
| 232897 | 12/1969 | U.S.S.R. | 61/45 D |
| 474624 | 9/1975 | U.S.S.R. | 61/45 D |

*Primary Examiner*—Dennis L. Taylor

*Attorney, Agent, or Firm*—Young & Thompson

[57] ABSTRACT

A mine roof support comprising a floor-engageable member, a roof-engageable member such as a canopy extending forwardly of the floor-engaging member, a first extensible leg secured between the floor-engaging member and the canopy, a linkage, which may include a shield, mounted on the floor-engaging member and pivotally connected to the roof-engageable member at its rear end and a second extensible leg secured between the floor-engaging member and the linkage. The linkage is preferably operative to constrain its pivotal connection to the canopy to move upward and downward in a fixed path relative to the floor-engaging member.

8 Claims, 8 Drawing Figures

MINE ROOF SUPPORT

This invention relates to a mine roof support for use in conjunction with a number of similar supports in a longwall mining system in a mine. In this specification the term "forward end" means that end of a roof support or a component thereof which will be nearer to a coal or mineral face when the support is in use in a mine, and the term "rear end" refers to the other end of the support or a component thereof.

In accordance with the present invention a mine roof support comprises a floor-engaging member, a roof-engageable member, a first extensible leg secured between the floor-engaging member and the roof-engageable member, a linkage mounted on the floor-engaging member and pivotally connected tothe roof-engageable member and a second extensible leg secured between the floor-engaging member and the linkage.

The linkage may be operative to constrain its pivotal connection to the roof-engageable member to move upward and downward in a fixed path relative to the floor-engaging member.

The linkage may be pivotally connected to the rear end of the roof engageable member.

The linkage may include a shield, which shield is pivotally connected to the roof-engageable member.

The shield may extend rearwardly and downwardly from the pivotal connection.

The linkage may include an upper link and a lower link pivotally mounted at spaced positions on the shield and at spaced positions on the floor-engaging member, arranged to constrain the pivotal connection to move in a substantially straight line at right angles to the floor-engaging plane of the floor-engaging member.

The first and second legs may be spaced from one another so that a miner can pass between them.

The first leg may extend forwardly and upwardly from the floor-engaging member and the second leg may extend rearwardly and upwardly from the floor-engaging member.

Two similar linkages may be provided, each having a pivotal connection to the roof-engageable member, said linkages being capable of independent movement, each said pivotal connection being capable of universal movement whereby the roof-engageable member may tilt when the linkages have different height settings.

The two linkages may each includes a shield, such shield being arranged to lie in close side-by-side relation when the linkages have the same height setting.

The two linkages may include spring means acting to urge the two shields into a close side-by-side relation. Such spring means may comprise a spring plate secured between either the two upper links of the linkages or between the two lower links of the linkages.

Two embodiments of the invention will now be described with reference to the accompanying drawings in which.

Figure 1:
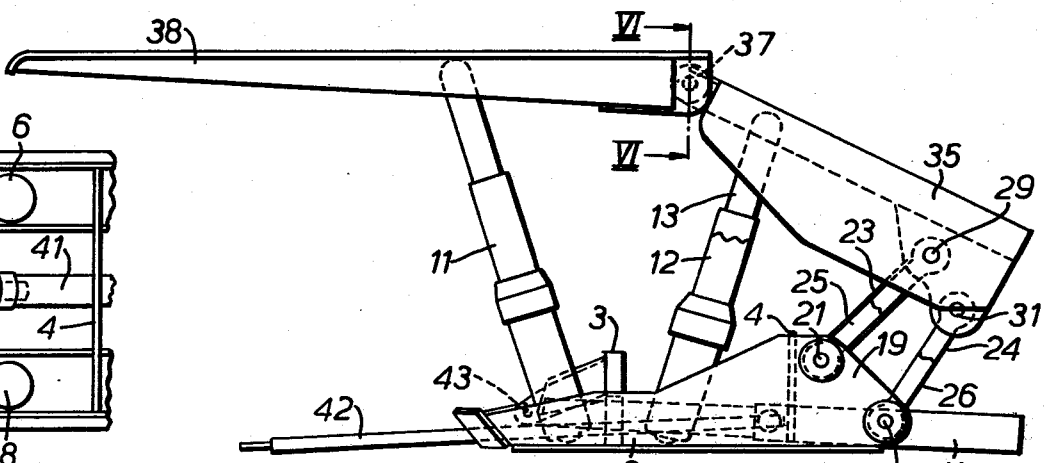
FIG. 1 is a side elevation of the mine roof support raised to its maximum height.

In the drawings the floor-engaging means comprises of pair of parallel floor-engaging beams 1 and 2 held substantially fixedly in their spaced relation by a front bridge member 3 and a rear bridge member 4. The beam 1 includes a front socket 5 and a rear socket 6 whilst the beam 2 includes a front socket 7 and a rear socket 8. Each of these sockets is intended to receive the lower end of a hydraulically extensible leg, the bottom surface of each socket being spherically shaped to receive the spherical lower end of a leg, the arrangement for each leg thus providing a pivotal connection. In the front sockets 5 and 7 a pair of legs 9 and 11 are mounted, such legs extending forwardly and upwardly from the sockets. In the sockets 6 and 8 a pair of second legs 12 and 13 are mounted, the leg 13 being visible only in FIG. 1 behind the leg 12. Each of the legs 9, 11, 12 and 13 are hydraulically extensible legs each being of the double telescopic kind whose fully contracted length is about one half of its fully extended length.

At the rear end of beam 1 there are provided a pair of upwardly-extending side plates 14 and 15 bored to receive a pair of transverse pivot pins 16 and 17. Similarly at the rear end of the floor beam 2 there are a pair of side plates 18 and 19 bored to receive a pair of transverse pins 21 and 22. The pivot pins 16 and 17 carry respectively upwardly and rearwardly-extending links 23 and 24 whilst the pins 21 and 22 carry a further pair of upwardly and rearwardly-extending links 25 and 26. The link 24 may be appreciated only in FIG. 1 where it appears directly behind the link 26. At their upper ends the links terminate at further pivot pins respectively 27, 28, 29 and 31 for the links 23 to 26. The pin 28 is not visible in the drawings but it will lie in FIG. 1 directly behind the pin 31. The pins 27 and 28 are carried by a pair of side plates 32 which in turn are integrally secured to a shield 33. Similarly the pins 29 and 31 are carried by a pair of side plates 34 which are integrally attached to a shield 35. Each of the shields 33 and 35 is formed by a strong metal beam supported in closely spaced parallel relation over the rear end of the associated floor beam by means of the links and respectively by the legs 12 and 13. The upper ends of the legs 12 and 13 are of part spherical shape to fit into sockets in the shield part 33 and 35 and thereby to form pivotal connections.

Figure 4:
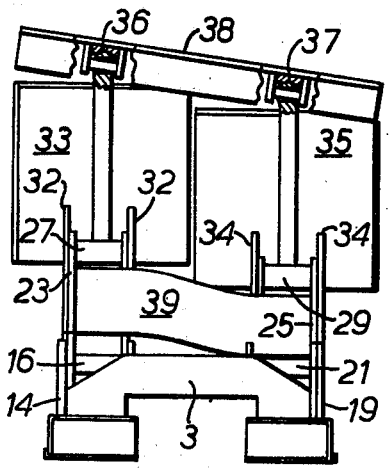
FIG. 4 is a front elevation similar to FIG. 3 but with the legs removed to show the spring means and the roof engageable means tilted.
Figure 5:
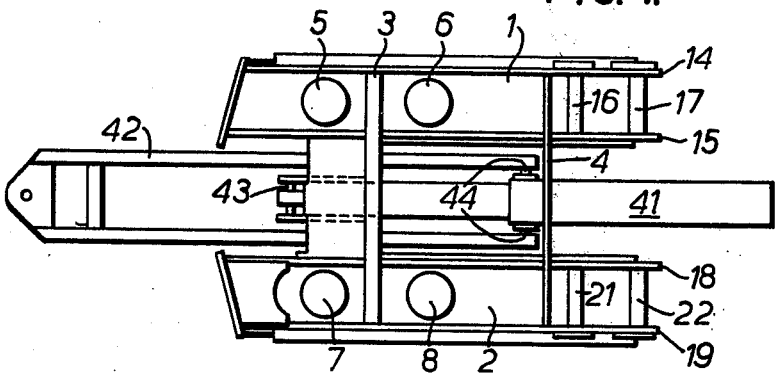
FIG. 5 is a plan view of the floor-engaging means of FIG. 1.

Each shield 33 and 35 terminates at its upper end respectively in pivotal connections shown as joints 36 and 37 which appear diagrammatically in FIG. 4. Each of these joints is capable of universal pivotal motion and will be described later in this specification with reference to FIGS. 6 and 7. The joints 36 and 37 connect to the rear end of a roof engageable member 38 which for convenience will be referred to as a canopy. The canopy extends forwardly from the joints 36 and 37 to a position considerably forward of the forward end of of the floor beams 1 and 2. The canopy 38 is further supported by the legs 9 and 11 each of which terminates at its upper end in a part spherical surface engaging in a co-operating socket in the canopy thereby providing for each leg a pivotal joint connection to the canopy. The links and the shields together form a linkage connected between the floor-engaging member and the pivotal joints 36 and 37 which act effectively as a single pivotal connection about an axis transverse to the canopy length.

For the purpose of tending to maintain the shields in a parallel side-by-side relationship the two upper links 23 and 25 have secured thereto a spring plate 39. Alternatively the spring plate may be connected to the lower links 24 and 26. When the shields 33 and 35 are urged to different positions the plate 39 will resiliently twist in the manner shown in FIG. 4.

The illustrated mine roof support is intended for use in a longwall mining system in which it will be placed with a number of similar supports in a line along the coal face, a scraper chain conveyor being located under the forward ends of the canopies adjacent to the face. Each support includes an advancing jack 41 and relay bar 42 by which it is connected to the conveyor, the jack 41 serving the functions of either pushing the conveyor forwardly towards the new face or alternatively when the support is released from the roof of pulling the support forward towards the conveyor. The advancing jack is pivotally connected to the forward cross member 3 at pivot pin 43 and the relay bar is pivotally connected to the jack 41 at pivot 44.

Figure 6:
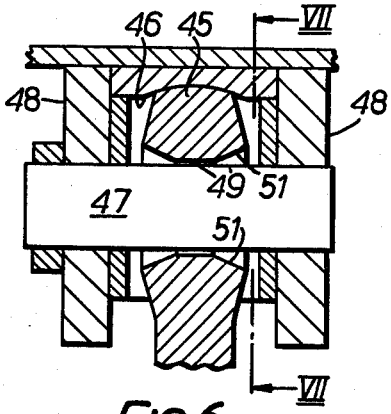
FIG. 6 is a cross-section to an enlarged scale taken on the line VI — VI of FIG. 1.
Figure 7:
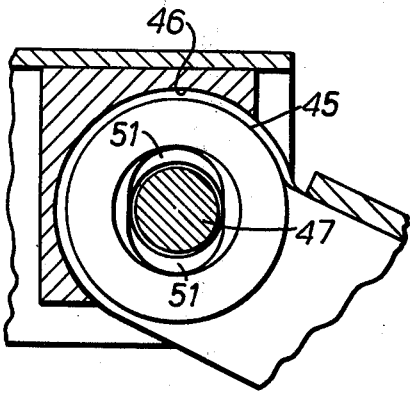
FIG. 7 is a cross-section taken on the line VII — VII of FIG. 6

Each of the joints 36 and 37 capable of universal movement, is constructed as shown in FIGS. 6 and 7. The upper end of the shield is formed with a part spherical projection 45 capable of engagement within a part spherical socket 46 which is fixedly secured to the rear end of the canopy 38. The socket 46 is so arranged that it embraces not more than 180° C. of the projection 45 having regard to the axis of a transverse locating pin 47. The pin 47 is carried by flanges 48 secured under the canopy adjacent to the socket 46, the pin extending through a transverse hole 49 in the projection 45. The hold 49 is slightly larger than the pin 47 and the outer ends of the hole 49 are upwardly and downwardly flared as at 51 to permit substantial tilting of the canopy relative to each shield about a fore and aft axis extending parallel to the length of the canopy, i.e. parallel to the direction of advancing movement of the whole support.

The positioning of the links and the pivot pins for each shield is such that the pivot pin 47 at the upper end of each shield is constrained to move in a substantially straight line at right angles to the floor-engaging surface of the floor beam. The linkage is sometimes known as a "lemniscate linkage."

Figure 2:
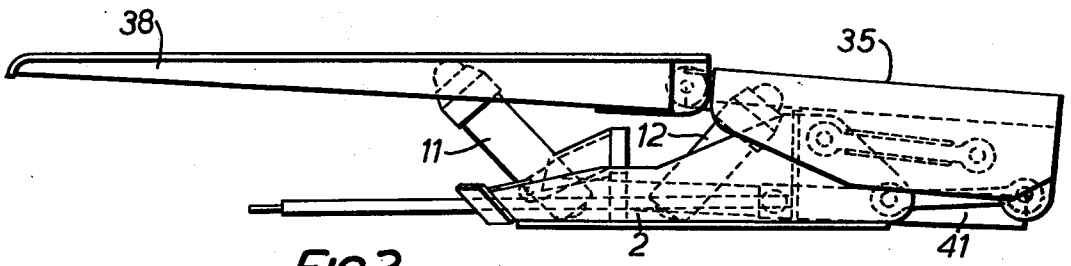
FIG. 2 is a side elevation of the roof support of FIG. 1 in its lowest position.

In use the support, along with a number of other supports, is located in a mine gallery and the hydraulic legs 9, 11, 12 and 13 are hydraulically connected through non-return valves to a source of hydraulic liquid at pressure to cause the legs to extend and to raise the canopy and the shield parts until the canopy engages the roof. The roof will be uneven and in order to ensure the most effective contact between the canopy and the roof, the canopy is able to tilt about two axes. The first of these axes is the horizontal common axis of the two pivotal joints 36 and 37. The second of these axes is the fore and aft lengthwise axis of the canopy 38. In tilting about the fore and aft axis of the canopy 38 the canopy will take up a tilted position as shown in FIG. 4, the vertical thrust between the shield parts and the canopy being transmitted through the contacting spherical surfaces 45 and 46 for each of the joints 36 and 37. The tilting will also be accommodated by virtue of the flared ends 51 of holes 49 permitting tilt of the pivot pins 47. In accommodating the canopy tilt shown in FIG. 4 the two shield parts 33 and 35 will rise to differing heights under the independent forces exerted by the legs 12 and 13 and the spring means 39 will resiliently deflect to the form shown in FIG. 4. The forward legs 9 and and 11 are forwardly and upwardly directed from their sockets 5 and 7 in the floor beams and thus will provide an upward thrust on the canopy 38 which has a forwardly directed component. It is an established mining fact that the roof engaging the canopy tends to move away from the coal face and such movement is deleterious to roof conditions. Such movement will apply a horizontal thrust to the canopy by virtue of the frictional engagement between the roof and the canopy. The forward component of thrust given by the forward legs 9 and 11 opposes this horizontal thrust, thereby also to a certain extent reducing the forces which need to be exerted by the links 23, 24, 25, 26 in maintaining the connections 36 and 37 against horizontal thrust. The rear legs 12 and 13 may either be upwardly and rearwardly inclined as shown in the drawings or they may be substantially vertical. The forward and rear legs diverge away from one another as they extend upwardly from their sockets in the floor beams and for a line of supports in position along the coal face the spaces between the legs of each support provide a passageway along which a miner may move along the line of supports under the protection of the canopy and away from the conveyor, thus providing a high degree of safety for the miner. For the most part this passageway is under the canopy and dust from the roof which may penetrate past the rear edge of the canopy will effectively not fall on the miner. By arranging that the pivotal joints 36 and 37 are effectively at the rear end of the canopy, the total length of the canopy is kept to a minimum and thereby for a particular roof support capability the canopy may be made lighter and less expensive. The shield must be of substantial strength to perform its fucntion of supporting the rubble falling from the roof after the roof has broken behind the rear edge of the canopy and in this proposal advantage is taken of the strength of the shield by placing the rear legs so as to engage the shield behind the pivotal connection to the canopy, thus providing space between the forward and rear legs. The thrust exerted by the forward legs 9 and 11 is adequate to provide an effective tip loading at the forward end of the canopy without the need to provide a tip loading jack on the canopy. Where both pairs of legs are inclined as shown, and also both arranged as double extension telescopic devices then, as will be seen from FIG. 2, the support is capable of being lowered to a quite low overall height. Thus the support as shown provides a very large range of height adjustment, considerably greater than for the majority of known roof supports.

Figure 8:
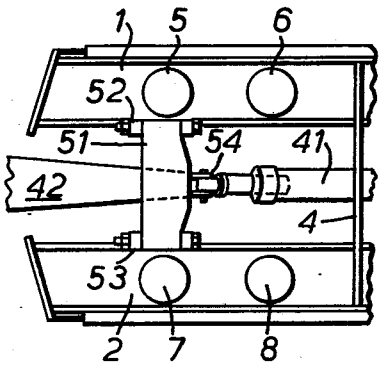
FIG. 8 is a plan view of the floor-engaging means of a modified embodiment of the invention.
Figure 3:
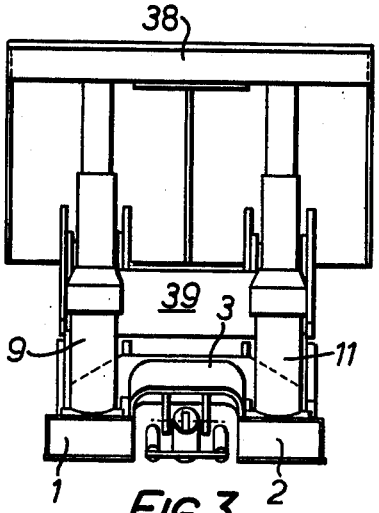
FIG. 3 is a front elevation of the support of FIG. 1 raised to its maximum height.

A modified embodiment of the invention is shown in FIG. 8. Here the modification is in the floor-engaging means and the remainder of the support is substantially as shown in the other Figures. Similar reference numerals will refer to similar parts appearing in the other Figures. As in the other Figures the floor-engaging means comprises a pair of floor-engaging beams 1 and 2, arranged in parallel relation and defining between them a gap within which a support advancing jack 41 is located. The floor beam 1 includes sockets 5 and 6 and the floor beam 2 includes sockets 7 and 8 to receive the bases of the extensible legs. The floor beams 1 and 2 are held substantially fixedly in their spaced relation by the bridge member 4 with the slight difference from the other Figures in that the bridge member 4 is capable of very slight spring movement. Near to their forward ends a second bridge member 51 is provided which differs substantially from the bridge member 3 of the other Figures. The bridge member 51 is secured to the floor beam 1 by means of a hinge 52 and to the floor beam 2 by means of a hinge 53, the axes of the two hinges both being parallel to the length of the floor beams. The bridge member 51 carries lugs 54 by which the advancing jack 41 is pivotally secured thereto and the relay bar 42 is connected to the lower side of the advancing jack cylinder to extend forwardly under the bridge 51 for connection to the conveyor.

The bridge member 51 performs the following functions:

(a) It maintains the spacing between the forward ends of the floor beams 1 and 2 at a substantially constant value.

(b) By virute of its hinged joints it permits relative angular movement between the forward ends of the floor beams about a transverse axis passing through the bridge member 4. This slight amount of movement enables the floor beams to accommodate themselves more effectively to an uneven floor.

(c) It forms a means by which the advancing thrust exerted by the advancing jack 41 may be exerted on the forward ends of the floor beams.

The invention also offers the advantage that the long canopy does not have sideways or "yaw" movement about its pivotal connection to the shield when the canopy tilts in the manner shown in FIG. 4 to accomodate itself to irregularity in the roof. With this point in mind it will be seen that the lack of "yaw" in the canopy ensures that the forward legs are always directed to provide a force acting in a fore and aft plane at right angles to the floor-engaging plane of the floor beam.

Within the broad scope of the present invention the two shields may be replaced by a single shield supported by the linkage system substantially as described with the loss of advantage of the ability of the canopy to tilt about its fore and aft axis. Also within the scope of the present invention the legs may take any conventional form and in particular the legs may be of the single extension telscopic kind with the disadvantage that the range of height adjustment is somewhat reduced. Further, within the scope of the present invention the rear legs may be substantially vertically arranged with some loss in advantage in that the height range of the support will be reduced. Nevertheless the spacing between the forward and rear legs will be retained providing a safe passageway along a line of supports for the miner.

We claim:

1. A mine roof support comprising a floor-engaging member resistant to bending along its whole length, a roof-engageable member above the floor-engaging member, a shield, a pivot means securing the roof-engageable member to the shield, a linkage securing the shield to the floor-engaging member for angular movement relative thereto to constrain the pivot means to a substantially straight path of movement towards and away from the floor-engaging member, an extensible forward leg, a pivotal connection on the roof-engageable member and a pivotal connection on the floor-engaging member between which connections the forward leg is secured lengthwise, an extensible rearward leg, a pivotal connection on the floor-engaging member and a pivotal connection on the shield between which pivotal connections the rearward leg is secured lengthwise, the said pivotal connections of said legs on the floor-engaging member being more closely spaced apart than said pivotal connections of said legs on said roof-engageable member and said shield, shortening of the legs to lower the roof-engageable member towards the floor-engaging member causing pivoting of both legs relative to the floor-engaging member, and in the lowest position for the roof-engageable member above the floor-engaging member the legs being at or near their minimum length and each leg being inclined at an acute angle to the floor-engaging member which angle is smaller than for elevated settings of the support.

2. A mine roof support as claimed in claim 1, wherein for the lowermost position of the roof-engageable member the forward leg extends forwardly and upwardly from the floor-engaging member, and the rearward leg extends rearwardly and upwardly from the floor-engaging member.

3. A mine roof support as claimed in claim 2, wherein said straight path for the pivot means is substantially perpendicular to the length of the floor-engaging member.

4. A mine roof support as claimed in claim 2, wherein the pivotal connections for the forward and rearward legs on the floor-engaging member are closely spaced relative to one another.

5. A mine roof support as claimed in claim 2, wherein the pivotal connection to the shield is at a position intermediate the linkage and the pivot means.

6. A mine roof support as claimed in claim 1, including two similar shields, two similar linkages and a pivot means for each shield connecting it to the roof-engageable means, each said pivot means being capable of universal movement.

7. A mine roof support as claimed in claim 6, wherein the shields are arranged to be in close side-by-side relation when they have the same height setting.

8. A mine roof support as claimed in claim 7, including spring means acting to urge the two shields into a close side-by-side relation.

* * * * *